US006568784B2

(12) United States Patent
Izumi et al.

(10) Patent No.: US 6,568,784 B2
(45) Date of Patent: May 27, 2003

(54) IMAGE RECORDING APPARATUS

(75) Inventors: Keiji Izumi, Hino (JP); Kenichi Okawa, Akiruno (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 10/096,009

(22) Filed: Mar. 12, 2002

(65) Prior Publication Data

US 2002/0130915 A1 Sep. 19, 2002

(30) Foreign Application Priority Data

Mar. 16, 2001 (JP) ..... 2001-075914

(51) Int. Cl.[7] ..... B41J 2/01
(52) U.S. Cl. ..... 347/19; 347/16
(58) Field of Search ..... 347/19, 16, 104; 400/74; 358/404

(56) References Cited

U.S. PATENT DOCUMENTS 6,267,519 B1 * 6/2001 Otsuki et al. ..... 400/283
6,290,319 B1 * 9/2001 Boleda et al. ..... 347/19

FOREIGN PATENT DOCUMENTS

JP 05-096796 A 4/1993

* cited by examiner

*Primary Examiner*—Craig Hallacher

(57) ABSTRACT

An image recording apparatus of the present invention comprises a conveying roller which conveys a print medium, a print head which conveys each of a plurality of sub-regions that are obtained by dividing the region of the print medium and records a test pattern each time the print medium is conveyed by the conveying roller in the region of the print medium corresponding to the convey amount of one rotation of the conveying roller, a CCD which reads a plurarity of the test patterns, and a control unit which calculates an interval between the previously recorded test pattern and the test pattern recorded after the print medium is conveyed, calculates the amount of deviation between the calculated interval and a predetermined interval as to all the test patterns recorded on the print medium, and calculates the average value of the amounts of deviation.

19 Claims, 10 Drawing Sheets

| n | △DA | △DC(△DA+△DBmean) | △DD(△Dmean-△DC) | △DE(△DD+△DBmean) |
|---|---|---|---|---|
| 1 | +3 | +5 | -1 | +1 |
| 2 | +10 | +12 | -8 | -6 |
| 3 | +4 | +6 | -2 | 0 |
| 4 | +4 | +6 | -2 | 0 |
| 5 | -4 | -2 | +6 | +8 |
| 6 | +4 | +6 | -2 | 0 |
| 7 | +16 | +18 | -14 | -12 |
| 8 | -12 | -10 | +14 | +16 |
| 9 | +3 | +5 | -1 | +1 |
| 10 | -8 | -6 | +10 | +12 |
| DA | +20 | | | |

DB=+20
△DBmean=+2
△D=+4

FIG. 7

IMAGE RECORDING APPARATUS

CROSS-REFERENCE TO RELATED APPLICATIONS

This application is based upon and claims the benefit of priority from the prior Japanese Patent Application No. 2001-075914, filed Mar. 16, 2001, the entire contents of which are incorporated herein by reference.

BACKGROUND OF THE INVENTION

1. Field of the Invention

The present invention relates to a print apparatus, and more particularly, to an image recording apparatus such as an inkjet printer capable of correcting a sheet convey amount error using a predetermined test pattern.

2. Description of the Related Art

Conventionally, in inkjet printers of a type for performing recording by ejecting ink from a print head having a plurality of nozzles, a serial type is mainly used in which an image is formed by reciprocating the print head above a print medium along a main scan direction while intermittently conveying the print medium. In this serial type, however, a problem arises in that a gap is caused between the lines of printed characters or the lines thereof overlap depending upon the accuracy of a convey amount of the print medium.

To improve the sheet convey accuracy, there is conceived an idea for improving the accuracy of parts used in a print medium convey mechanism and improving the assembling accuracy of the convey mechanism. However, this idea requires a higher level of check and management. That is, in the inkjet printer, the mechanical improvement of the media convey accuracy results in an increase in a product cost.

To solve the above problem, Jpn. Pat. Appln. KOKAI Publication No. 5-96796 discloses a technology as to "recording method and apparatus". According to this technology, a test pattern is printed on a print medium and read by a reading unit, a sheet convey amount error is calculated based on a result of the read test pattern, and the print medium is conveyed based on a correction value for correcting the error.

That is, in this technology, a plurality of vertical lines (test pattern) are printed along a sub-scan direction, the leading and trailing end addresses of the respective vertical lines are read by the reading unit, and the difference (E−S) between the leading end address S of a noted vertical line and the trailing end address E of a vertical line in front of the noted vertical line is determined. Then, the sheet convey amount error in correspondence to the difference (E−S) is corrected, and a thus corrected sheet convey amount is stored in a memory.

When an image is actually recorded, a sheet convey amount error according to each line feed position is referred to from the memory, and a drive signal based on the sheet convey amount error is applied to a sheet convey motor. With this operation, the print medium can be conveyed accurately over the entire surface thereof.

In the technology disclosed in Jpn. Pat. Appln. KOKAI Publication No. 5-96796, however, the vertical lines as the test pattern are printed as many as 70 lines in the vertical direction of an A4 size print medium and are read by the reading unit one by one in order to calculate the correction value for correcting the sheet convey amount error. That is, the vertical lines are printed the number of times corresponding to the number of times of convey of the print medium that are necessary to record an image, the amount of dislocation of the print medium to a predetermined sheet convey amount is read over the entire surface of the A4 size print medium, and a correction value for correcting a sheet convey amount error, which arises each time the print medium is conveyed, is calculated. While this method is effective in the A4 size print medium, it is hard to say that this method is also effective to a print medium larger than the A4 size and to a rolled print medium because it requires a long processing time in them.

In contrast, various types of print medium such as a thin sheet, a thick sheet, and a sheet having a large or small coefficient of friction are used in the inkjet printer. In this circumstances, a problem arises in that even if the same sheet convey pulse is supplied to a sheet convey motor, a recording sheet as a print medium is conveyed in a different amount depending upon whether the print medium is thick or thin and depending upon whether or not the print medium has a large coefficient of friction. In this point, the conventional technology records test data over the entire surface of a print medium and calculates the correction value for correcting the sheet convey amount error even if the above disadvantage exists, and thus it requires a long processing time.

BRIEF SUMMARY OF THE INVENTION

An object of the present invention is to provide an inkjet printer capable of effectively determining a sheet convey amount error and calculating an appropriate correction value without recording and reading teat data over the entire region of a print medium. Another object of the present invention is to provide an image recording apparatus such as an inkjet printer capable of using print medium having a different thickness, determining an appropriate sheet convey amount error for each sheet having a different thickness and a different coefficient of friction and calculating an appropriate correction value easily and promptly.

In more detail, an object of the present invention is to save the useless consumption of time, an amount of ink, and sheets when a sheet convey amount error is measured by using a length corresponding to the sheet convey amount of the one rotation of a conveying roller as a measurement range when the sheet convey amount error is measured.

Another object the present invention is to permit a sheet convey multiplication ratio for correcting deviation in convey amount, which is a factor for causing the above sheet convey amount error, to be independently calculated and to permit the sheet convey multiplication ratio to be calculated according to each recording mode.

To achieve the above objects, according to a first aspect of the present invention, there is provided an image recording apparatus comprising: a conveying roller which conveys a print medium; a print head which is capable of scanning the print medium in a direction perpendicular to the direction where the print medium is conveyed by the conveying roller and which records a test pattern on the print medium; a scanner which reads the test pattern recorded on the print medium; and an arithmetic operation circuit which calculats the convey amount error of the conveying roller based on the result detected by the scanner, wherein the conveying roller conveys each of a plurality of the sub-regions that are obtained by dividing the region of the print medium, which corresponds to the convey amount of the print medium conveyed by the one rotation of the conveying roller, at a time; the print head records a test pattern each time the print medium is conveyed by the conveying roller and records a plurality of test patterns in the region of the print medium corresponding to the convey amount of the one rotation of the conveying roller; and the arithmetic operation circuit: calculates an interval between (two) test patterns that are adjacent to each other along the direction where the print medium is conveyed; calculates the amount of deviation between the calculated interval and an ideal interval as to all the test patterns recorded on the print medium; and calculates the average value of the amounts of deviation.

Further, according to a second aspect of the present invention, there is privided an image recording apparatus comprising: a conveying roller which conveys a print medium; a convey motor which applies rotational drive to the conveying roller; a print head which records test patterns on the print medium; a carriage which causes the print head mounted thereon to perform scan in a direction perpendicular to the direction where the print medium is conveyed by the conveying roller; a sensor which optically reads the test patterns recorded on the print medium; and an arithmetic operation circuit which calculates the convey amount error of the conveying roller based on the result detected by the scanner, wherein the print head records a test pattern each time the print medium is conveyed by the conveying roller and records a plurality of test patterns in the region of the print medium corresponding to the convey amount of the one rotation of the conveying roller; and the arithmetic operation circuit: calculates an interval ΔDAn of test patterns that are adjacent to each other along the direction where the print medium is conveyed as to intervals of all the test patterns and calculates a total sum DA of the intervals; calculates the amount of deviation DB between the thus calculated total sum DA of the intervals and a total sum D of ideal intervals; calculates a first correction amount ΔDBmean by calculating the average value of the amount of deviation DB between the total sums DA and D; calculates a primary correction interval ΔDCn by adding the first correction value ΔDBmean to the intervals ΔDAn of the respective test patterns; calculates a second correction amount ΔDDn by calculating the difference between the first correction amount ΔD and the primary correction interval ΔDCn; and adds the first correction amount ΔDBmean to the second correction amount ΔDDn.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiment of the invention, and together with the general description given above and the detailed description of the embodiment given below, serve to explain the principles of the invention.

FIG. 7 is a table showing a process of calculating a correction value according to the test pattern shown in FIG. 6;

DETAILED DESCRIPTION OF THE INVENTION

An embodiment of the present invention will be described below with reference to the drawings.

An inkjet printer acting as an example of an image recording apparatus will be described here.

Figure 1:
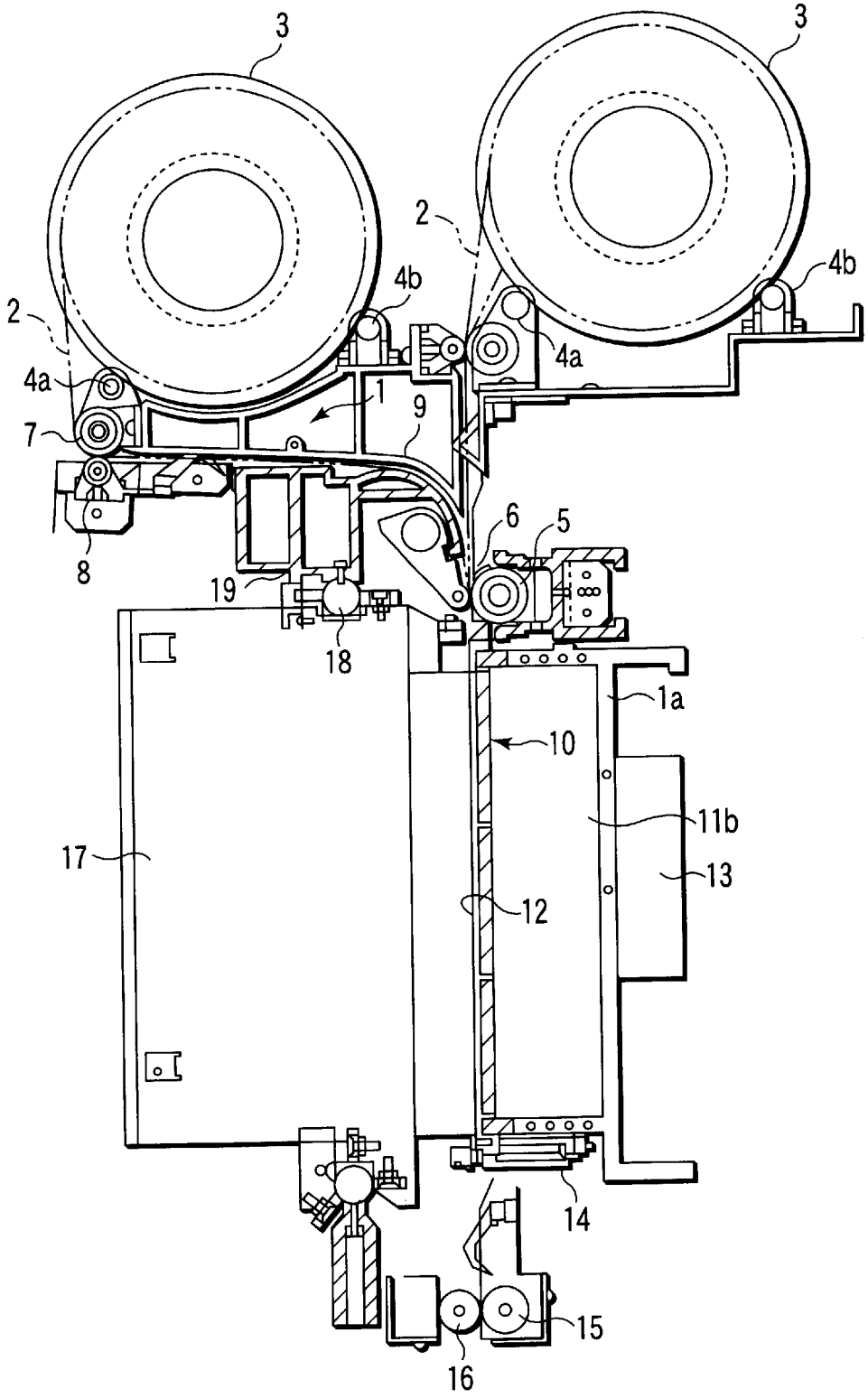
FIG. 1 is a view showing an arrangement of a main part of an inkjet printer as an image recording apparatus according to an embodiment of the present invention.
Figure 2B:
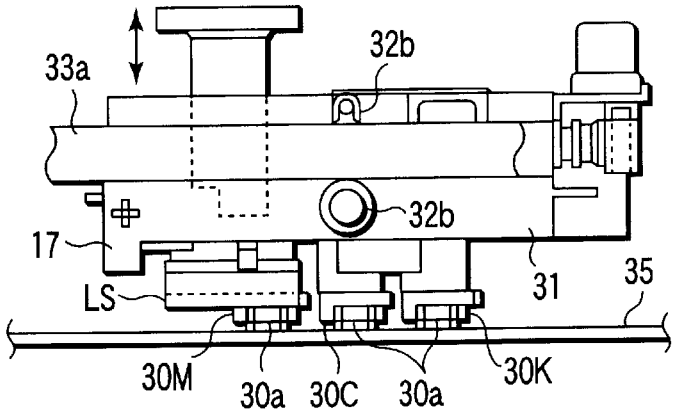
FIGS. 2A to 2C are views of the inkjet printer when a carriage 17 is viewed from a platen 10 side.
Figure 2A:
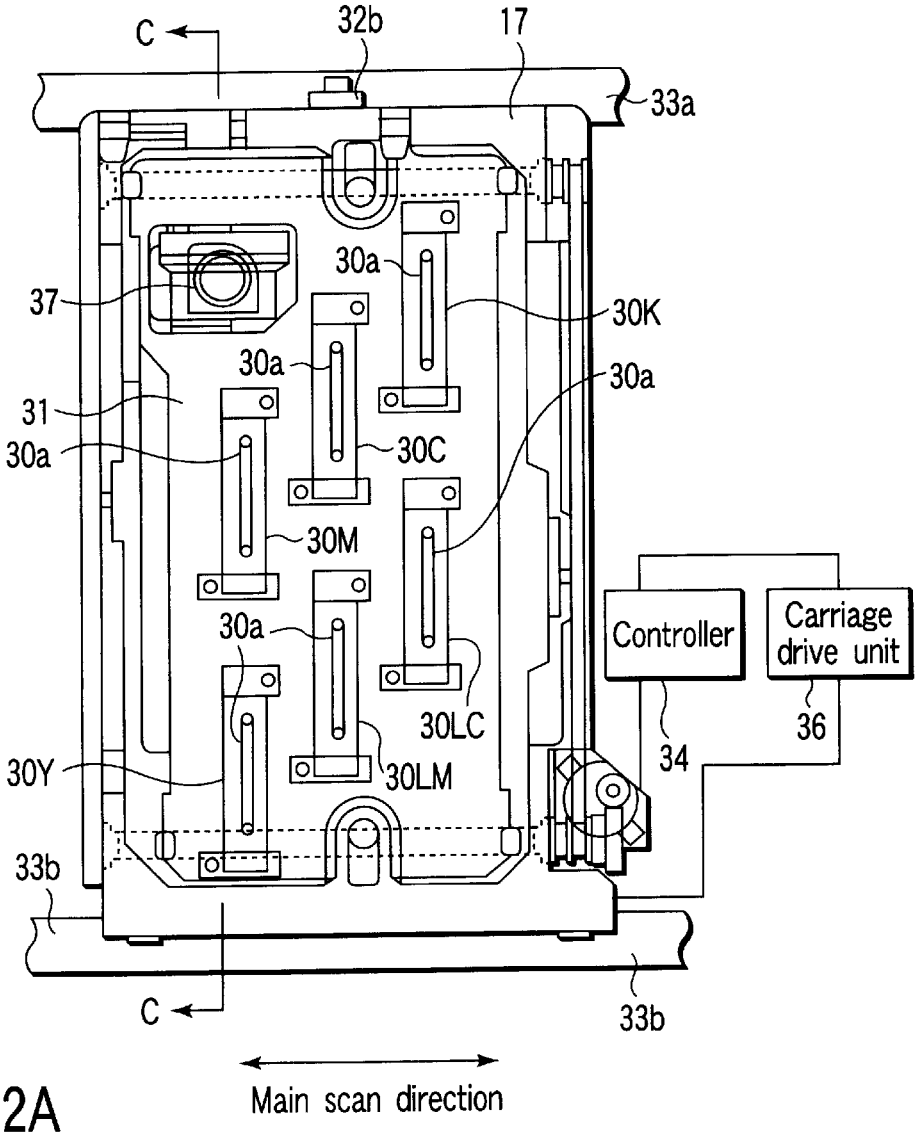
Figure 2C:
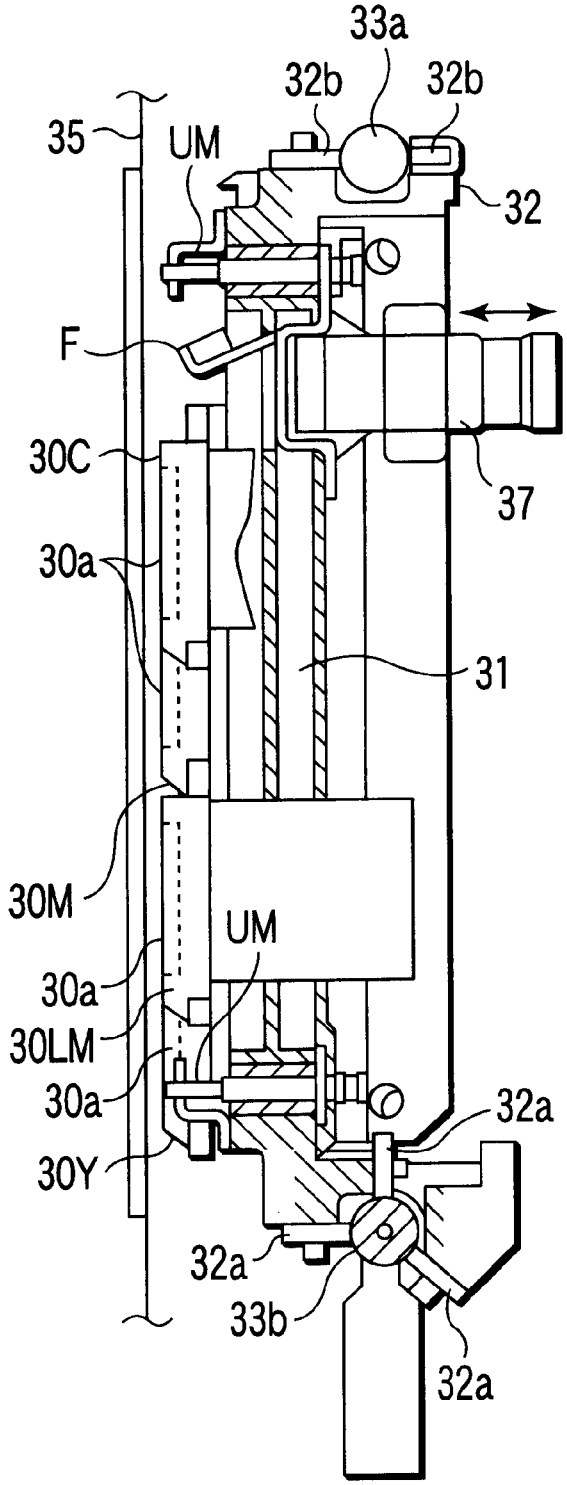

First, FIG. 1 shows a main part of the inkjet printer according to the embodiment of the present invention, and FIGS. 2A to 2C show the inkjet printer when a carriage 17 is viewed from a platen 10 side. The inkjet printer shown in these figures will be described below in detail.

In FIG. 1, the inkjet printer according to the embodiment holds two roll sheets 2 each rolled in a roll-shape at two positions separated from each other in a back and forward direction above a support frame 1. A pair of disc-shaped paper tube holders 3 are concentrically attached to both the ends of each roll-shaped sheet 2. The pair of paper tube holders 3 are rotatably placed on a pair of roll sheet support rollers 4*a* and 4*b* that are disposed at two position in the back and force direction above the support frame 1.

In this support frame 1, a nip point between a conveying roller 5 and a convey pinch roller 6 is disposed below the two roll-shaped sheets 2 therebetween. The conveying roller 5 is composed of a single roller having a width slightly longer than that of the sheet 2 and is rotated by a known drive unit such as a convey motor 58 at a predetermined speed in a predetermined direction.

Further, the convey pinch roller 6 is composed of a plurality of rollers that rotate freely and are spaced apart from each other at predetermined intervals in the lengthwise direction of the conveying roller 5. These rollers that rotate freely are urged against the conveying roller 5 by an urging unit (not shown).

A front roll-shaped sheet 2, which is located on a front side, that is, in the left side direction in FIG. 1, is drawn out to the nip point between the conveying roller 5 and the convey pinch roller 6 through a nip point between a front sheet feed roller 7 and a front pinch roller 8 and through a front sheet guide path 9.

Then, the front sheet feed roller 7 is rotated by a known drive unit such as a convey motor 58 in a predetermined direction at a predetermined speed.

The support frame 1 has the platen 10 acting as a sheet support unit. The platen 10 is disposed on the support frame 1 below the nip point between the conveying roller 5 and the convey pinch roller 6 behind it, that is, on the right side in FIG. 1. The front surface 12 of the platen 10 extends two-dimensionally in a sheet convey direction and in a sheet width direction. A platen stay 1*a* for fixing the platen 10 includes a suction fan 13 that acts as suction means for evacuating a platen chamber 11*b*.

A sheet cutter 14 is mounted on the platen stay 1*a* at the lower end thereof, and a nip point between a sheet discharge roller 15 and a discharge sheet pinch roller 16, which are fixed on the support frame 1, is disposed below the sheet cutter 14.

In this embodiment, sheet convey means for conveying the front roll-shaped sheet 2 in a predetermined direction is composed of the combination of the front sheet feed roller 7 and the front pinch roller 8, the combination of the conveying roller 5 and the convey pinch roller 6, and the combination of the sheet discharge roller 15 and the discharge sheet pinch roller 16.

The support frame 1 has a carriage 17 disposed in front of the platen 10, and the carriage 17 has a plurality of print heads mounted thereon. The print heads act as image recording means for ejecting a plurality of types of ink having a different density.

Two movement guide bars 18, which extend horizontally in parallel with each other, are disposed on and under the carriage 17 and are fixed to the support frame 1. These two movement guide bars 18 are disposed in parallel also with the front surface of the platen 10 and guides the carriage 17 so that it can reciprocate in parallel with the platen 10. A linear encoder 19 is interposed between the carriage 17 and the upper movement guide bar 18 to detect the position of the carriage 17 in the sheet width direction. The carriage 17 can be reciprocated by known reciprocatingly drive means which includes a carriage motor 59 along the two movement guide bars 18 in a predetermined range. The predetermined range is located between the home position of the carriage 17 and the position where it reverses its course in the reciprocating motion thereof.

In FIGS. 2A to 2C, the inkjet printer according to this embodiment has six print(inkjet) heads 30K, 30C, 30M, 30LC, 30LM, and 30Y each mounted on the carriage 17 to eject black (K) ink, cyan (C) ink, magenta (M) ink, light cyan (LC) ink, light magenta (LM) ink, and yellow (Y) ink to form an image in full color.

Then, the former three print heads 30K, 30C, and 30M are disposed on the surface of the carriage 17 facing the platen 10 such that they do not overlap each other in the sheet convey direction as well as they are sequentially dislocated to one side of the platen 10 in the sheet width direction as they are located downward. Further, the latter three print heads 30LC, 30LM, and 30Y are disposed similarly to the former three print heads 30K, 30C, and 30M therebelow.

Each of the six print(inkjet) heads has a nozzle row L having a predetermined number of nozzles that are disposed in the sheet convey direction at the same intervals. These nozzle rows L are disposed at the same predetermined intervals when attention is paid only to the sheet convey direction while they are dislocated in the sheet width direction.

Corresponding color ink is supplied from a main ink bottle, which is mounted on a fixed frame (not shown) of the inkjet printer and in which black ink, cyan ink, magenta ink, light cyan ink, light magenta ink, and yellow ink are accommodated, by an ink feed pump (not shown) through a flexible ink feed tube (not shown).

The carriage 17 is supported by a pair of guide bars 33*a* and 33*b*, which extend along a main scan direction as a first direction, that is, in a right and left direction in FIGS. 2A to 2C, so as to move in a predetermined range. More specifically, in this embodiment, the pair of guide bars 33*a* and 33*b* are separated from each other in a sub-scan direction as a second direction, that is, in an up and down direction in FIGS. 2A to 2C. Then, the carriage 17 is supported by a roller 32*b*, which is disposed thereabove and is composed of a plurality of sub-rollers, and by a roller 32*a*, which is disposed therebelow and is composed of a plurality of sub-rollers, so as to move in the main scan direction along upper and lower guide bars 33*a* and 33*b*.

The carriage 17 is formed in a squire frame shape and has a head holding member 31 disposed in the space at the center thereof. The head holding member 31 holds the six print heads.

Optical image reading meas 37 is further mounted on the head holding member 31 in confrontation with a print medium 35. Further, a light source LS is also amounted on the head holding member 31 to illuminate light to the focal point F of the image reading means 37.

In this embodiment, the image reading means 37 is composed of a charge coupled device (CCD), and the light source LS is composed of a light emitting device that is small in size and saves power consumption. In the following description, it is assumed that reference numeral is a CCD.

The carriage 17 is driven by known drive means 36 and can be reciprocated in the main scan direction by being supported by the pair of guide bars 33*a* and 33*b*.

The known drive means 36 is composed of a pair of pulleys (not shown), which is disposed at both the ends in the main scan direction of the drive means 36, respectively, a timing belt (not shown), which is stretched between the pair of pulleys and is fixed on the carriage 17, and a convey motor 58 for driving one of the pair of pulleys. The convey motor 58 of the drive means 36 is also connected to a controller 34 and controlled thereby. The flat platen 10 that supports the print medium 35 is disposed in front of the respective print heads 30.

Figure 9:
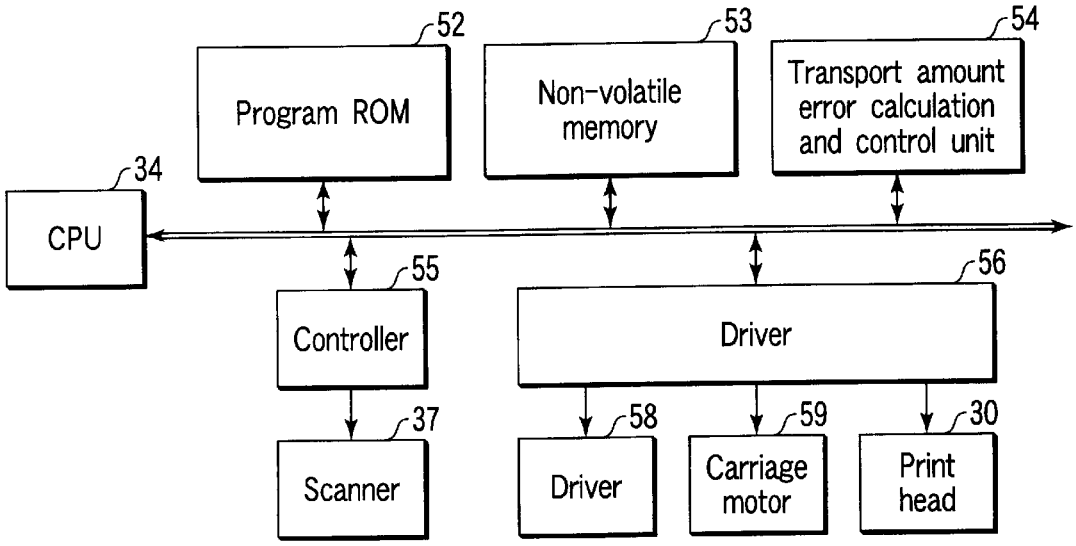
FIG. 9 is a block diagram showing an arrangement of the inkjet printer as the image recording apparatus according to the embodiment of the present invention.

Here, an arrangement of a control system of an image recording apparatus according to this embodiment will be described with reference to FIG. 9. As shown in FIG. 9, a program ROM 52, a non-volatile memory 53, a convey amount error calculation and control unit 54, a controller 55, and a driver 56 are connected to a CPU 34 for controlling the apparatus in its entirety through a control bus 50 so as to freely communicate therewith. Various types of control programs are previously stored in the program ROM 52. Various types of data is temporarily stored in the non-volatile memory 53. The convey amount error calculation and control unit 54 calculates the sheet convey amount error by the method as described above. A scanner 37 is driven and controlled by the controller 55. The driver 56 drives and controls a convey motor 58, a carriage motor 59, and a print head 30.

In general, a sheet convey amount error to a target sheet convey amount is mainly caused by so-called "irregularity in convey" of sheet and so-called "deviation in convey amount" of sheet, The "irregularity in convey" is caused by the decentering of the conveying roller 5, and the "deviation in convey amount" is caused by the expansion and contraction (wear) of the convey surface of the conveying roller 5, the difference of a thickness of a sheet, and the difference in a coefficient of friction of a sheet. In the following description, an error caused by the irregularity in convey and the deviation in convey amount is referred to as "sheet convey amount error", and a coefficient acting as a correction value for reducing the affect of the deviation in convey amount is referred to as a "sheet convey magnification ratio".

Figure 3:
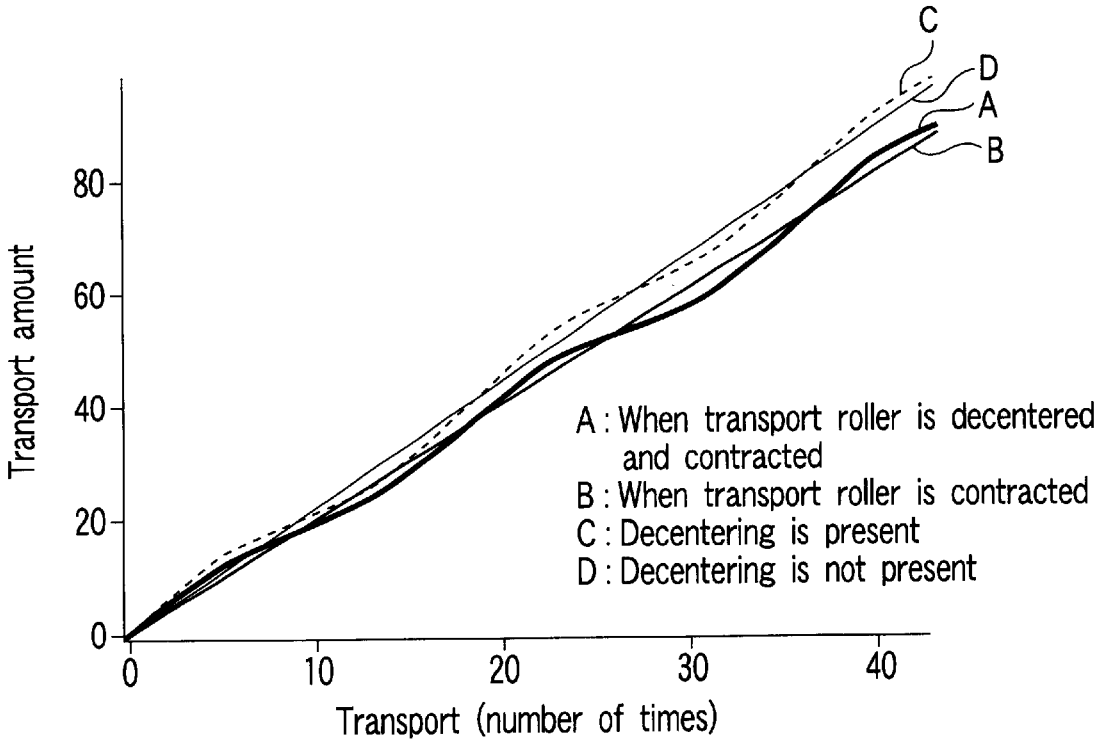
FIG. 3 is a graph showing a relationship between the number of times of convey and a convey amount.

FIG. 3 shows a relationship between the number of times of convey and a convey amount to explain the affect of the "irregularity in convey" and the "deviation in convey amount". Note that, in FIG. 3, "A" shows a convey amount when the irregularity in convey and the deviation in convey amount, which is caused by the wear, and the like of the conveying roller 5, occur at the same time; "B" shows only a convey amount in which the deviation in convey amount is caused by the contraction (wear), and the like of the conveying roller 5; "C" shows a convey amount in which only the irregularity in convey is caused; and "D" shows a convey amount in an ideal case (which is neither affected by the irregularity in convey nor affected by the deviation in convey amount).

It can be found from FIG. 3 that the convey amount (B) when the conveying roller 5 is contracted is no more than that the gradient thereof is reduced at a given ratio with respect to the ideal convey amount (D). Accordingly, when attention is paid to this point, it is possible to correct the deviation in convey amount caused by the contraction of the conveying roller 5 by calculating the difference between the gradients of both the convey amounts (B) and (D) as a coefficient, and by multiplying the number of drive pulses, which correspond to the ideal convey amount and are supplied to a convey motor 58 for driving the conveying roller 5, by the coefficient, that is, the sheet convey magnification ratio.

Further, even if the irregularity in convey is caused by the decentering of the conveying roller 5, the convey amount of a sheet conveyed by the one rotation of the conveying roller 5 is the same as the ideal convey amount. Accordingly, when a test pattern is printed and a correction value is calculated by reading the test pattern, the test pattern can be printed and read using the convey amount of the sheet corresponding to the one rotation of the conveying roller 5 as a measuring range of the test pattern. Accordingly, when the deviation in convey amount, which is caused when the circumference of the conveying roller 5 changes and thus the length of the convey surface thereof changes, and the irregularity in convey, which is caused by the decentering of the conveying roller 5, are measured, respectively, it is sufficient to use the circumferential length of the conveying roller 5 when it rotate once as the measuring range of the test pattern.

In view of the above-mentioned, this embodiment corrects the deviation in convey amount by calculating the coefficient described above, that is, the "sheet convey magnification ratio". The deviation in convey amount can be easily and effectively corrected by previously calculating the sheet convey magnification ratio for each sheet having a different thickness, for each sheet having a different coefficient of friction and further for each recording mode (single path recording mode and multi-path recording mode). This will be described below in more detail.

First, a method of calculating the correction value of the irregularity in convey, the correction value of the deviation in convey amount, and the sheet convey magnification ratio will be described as to a case where single path recording is taken into consideration.

Figure 4:
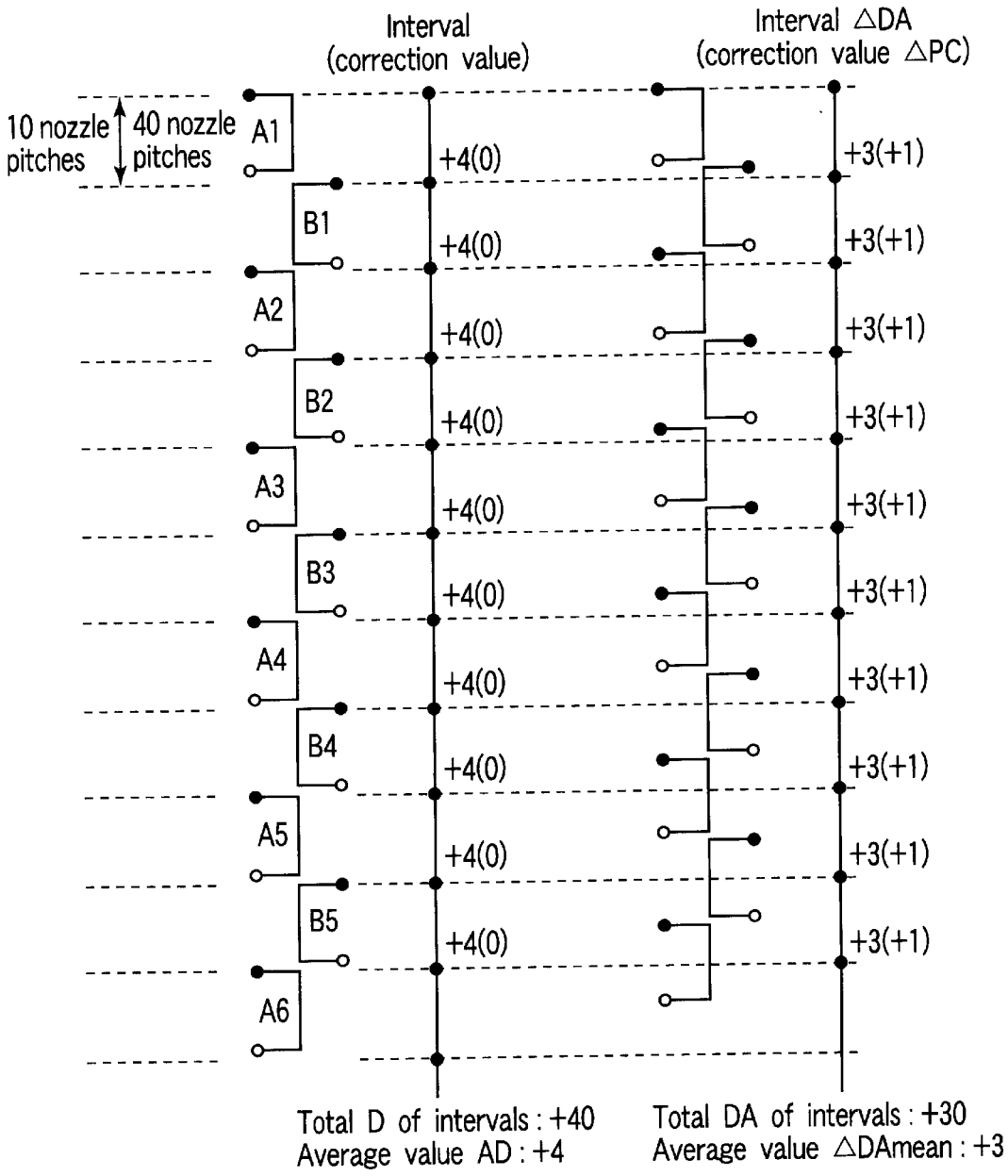
FIG. 4 is a view showing an example of a test pattern in a single path print employed by the inkjet printer according to the embodiment of the present invention.

FIG. 4 shows an example of a test pattern employed by the inkjet printer according to this embodiment, and a method of printing the test pattern will be described. It is assumed that a print head used here has ten nozzles and that image information of the test pattern is previously stored in the program ROM 52.

Further, it is assumed that when the test pattern is printed, data is read from the trogram ROM 52, and the test pattern is printed by driving the print head 30.

The test pattern employed here is composed of patterns A and patterns B. That is, the patterns A are printed by the main scan performed at odd time, and the patterns B are printed by the main scan performed at even times. More specifically, each pattern A is a C-shaped image that opens toward the left end side of a sheet, and each pattern B is a C-shaped image that opens toward the right end side of the sheet.

Here, each of the patterns A and B has horizontal line portions, which extend in the main scan direction and have a length set to 5 dots, and a vertical line portion, which extends in a sub-scan direction and has a length set to 10 dots. In any of the patterns A and B, the horizontal line portion is printed by first and tenth nozzles, and the vertical line portion is printed using all the nozzles.

A print process will be described below. First, a pattern A is printed from a predetermined position on a print medium 35. On the completion of print of the pattern A, the print medium 35 is conveyed by a length corresponding to the only 10 nozzle pitches of the print head. Since 4 drive pulses/nozzle pitch are supplied to a convey motor 58, 40 drive pulses are supplied thereto.

Subsequently, when the print medium 35 is conveyed in an amount corresponding to 40 pulses, a pattern B is printed. On the completion of print of the pattern B, the print medium 35 is conveyed by supplying 40 drive pulses to the convey motor 58, similarly to the above operation.

Thereafter, the print of a pattern A, the convey of the print medium in the amount corresponding to 40 pulses, the print of a pattern B, and the convey of the print medium 35 in the amount corresponding to 40 pulses are sequentially repeated until the total convey amount of the print medium 35 reaches the convey amount that is achieved when the conveying roller rotates once. As a result, each five pieces of the patterns A and B, that is, 10 patterns in total are printed. Then, the sheet is further conveyed by an amount corresponding to 40 pulses, and finally a pattern A is printed, thereby the print of the test pattern is finished.

As described above, the test pattern having been printed is read by the CCD 37. That is, the CCD 37 is mounted on the carriage 17, and the test pattern is read thereby by conveying the print medium 35 in a state in which the carriage 17 is stopped at a predetermined position. The CCD 37 is divided into a plurality of regions according to the respective reading functions thereof along a direction in which the image pickup elements thereof are disposed. That is, the CCD 37 can read the vertical line portions of the patterns A and B by the central region thereof. Further, the CCD 37 can read the horizontal line portions of the pattern A by the left region thereof, and the horizontal line portions of the pattern B by the right region thereof.

An actual "reading procedure" will be described below assuming an ideal case where a test pattern as described above is printed without being affected by the irregularity in convey and the deviation in convey amount.

First, the CCD 37 is moved to an main scan initial position. That is, the carriage 17 is matched with the print medium 35 by moving the carriage 17 in the main scan direction and by conveying the print medium 35 in the sub-scan direction by the convey motor 58.

Next, a reference position is matched with the position of the CCD 37 by driving only the convey motor 58. In this example, the reference position is set to the upper horizontal line of a pattern A1 printed at the uppermost position of the print medium 35. Then, an output value output from the CCD 37 is read while conveying the print medium 35 by supplying drive pulses to the convey motor 58 one by one.

Note that it goes without saying that the print medium 35 may be continuously conveyed in an amount corresponding to about 35 pulses when the upper horizontal line of each test pattern is detected. A main reason of this operation resides in that it is meaningless to detect the vertical line portion of each test pattern. In a test pattern that is printed under ideal conditions, when the print medium 35 is conveyed in an amount corresponding to 36 pulses, the lower horizontal line potential of the pattern A1 is detected by the element row in the left region of the CCD 37.

When an output value is obtained from the image pickup elements of the left region of the CCD 37, it is recognized that the horizontal lines having been read belong to a pattern A. The lower horizontal line of the pattern A1 and the position thereof when it is detected (actually, this position is represented by the cumulative number of drive pulses applied to the sheet convey motor) are stored in the non-volatile memory 53 in associated with each other.

In an ideal state, the interval between the lower horizontal line of the pattern A1 and the upper horizontal line of a pattern B1 corresponds to 1 nozzle pitch, that is, to 4 pulses. Accordingly, when the print medium 35 is conveyed by 4 pulses after the lower horizontal line of the pattern A1 is detected, the upper horizontal line of the pattern B1 is detected. In this example, when a small output value (white: high level, black: low level) is obtained from the image pickup elements of the right region of the CCD 37, it is recognized that the horizontal line having been read belongs to a pattern B.

Actually, when the horizontal line of the pattern B1 is detected, the position thereof (actually, this position is represented by the cumulative number of drive pulses applied to the sheet convey motor) is stored in the non-volatile memory 53.

When the print medium 35 is conveyed as described above, which of patterns A and B is detected is discriminated depending upon which of the image pickup elements of the right and left regions of the CCD 37 detect a horizontal line, and the detected pattern and the number of pulses used to convey the print medium 35 when the pattern is detected are stored in the nonvolatile memory 53 in association with each other.

The above processing is performed until the upper horizontal line of a pattern A6 is detected or until the print medium 35 is conveyed a predetermined distance.

Next, methods of calculating various types of correction values will be described.

First, a method of calculating a correction value for correcting deviation in convey amount due to the change of the convey surface length of the conveying roller 5 will be described.

FIG. 4 shows a test pattern, which is printed in an ideal state without deviation in convey amount, on a left side, and shows a test pattern, in which only deviation in convey amount due to the change of the convey surface length of the conveying roller 5 is caused, on a right side.

Here, the total sum DA of the intervals ΔDA between the lower horizontal lines of preceding test patterns and the upper horizontal lines of succeeding test patterns captured in the non-volatile memory 53 is calculated by the following formula.

$$DA=\Delta DA1+\Delta DA2+, \ldots, +\Delta DA10$$

In the test pattern shown on the right side of FIG. 4, the total sum DA of these intervals is 30 pulses. In contrast, in the ideal state, all the intervals ΔD between the respective horizontal lines are 4 pulses and the number of times of measurement is 10 times, thus the total sum D of the intervals is 40 pulses. The value ΔD=4 pulses in this ideal state is previously stored in the program ROM 52, and a reference value D is obtained by multiplying the reference value D by the number of times of measurement.

Next, the difference DB between the total sum DA of the respective intervals ΔDAn and the reference value D is calculated.

$$DB=D-DA$$

In this example, DB is 10 pulses because D=40 and DA=30. Thus, it can be found that the actual convey amount of the print medium conveyed by the one rotation of the conveying roller 5 is 10 pulses less than that of the one rotation of the conveying roller 5.

That is, the length (which corresponds to 10 nozzles or 40 pulses) between the upper and lower horizontal lines of each pattern A and B of the test pattern is constant at all times regardless of the presence or absence of the deviation in convey amount of the print medium and regardless of the quantity of the deviation. Accordingly, the difference DB of 10 pulses acts as the sheet convey amount error of the one rotation of the conveying roller 5 as it is.

Next, the average value ΔDBmean of ΔDB is determined.

$$\Delta Dmean=DB/n$$

where, n means the number of times of measurement. Since n=10 here, ΔDBmean is +1 (pulse). This average value ΔDBmean corresponds to a correction value for allocating the deviation in convey amount of the one rotation of the conveying roller 5 to the convey amount of the sheet each time it is conveyed.

Next, a primary correction value ΔDC is calculated by adding ΔDBmean to ΔDAn. Note that ΔDCn means a primary correction pulse value to the reference pulse (40 pulses).

$$\Delta DCn=\Delta DAn+\Delta DBmean$$

When the primary correction pulse values ΔDCn (n=1 to 10) are calculated by the above arithmetic operation, it is determined whether or not all of them equal the interval ΔD (4 pulses) in the ideal state.

In this example, all the intervals ΔDAn are 3 pulses. Thus, the addition of 1 pulse of ΔDBmean to 3 pulses of each interval ΔDCn results in 4 pulses which equals ΔD.

When the relationship ΔDCn=4 is established, ΔDBmean (1 pulse) is stored in the non-volatile memory 53 as a final correction value.

In FIG. 4, the numerical values in parentheses show the average value ΔDBmean that serves as the correction value for correcting the deviation in convey amount due to the change of the convey surface length of the conveying roller 5.

That is, while the interval between the lower horizontal line of a pattern printed in previous scan and the upper horizontal line of an intended pattern essentially requires 4 pulses. Whereas, the respective intervals measured in the actual state are only 3 pulses, from which a shortage is caused in a convey amount. To cope with this problem, 1 pulse corresponding to the shortfall is uniformly added to 40 pulses that is the drive pulses corresponding to the convey amount of each 10 nozzles to thereby obtain the interval of 4 pulses that is an ideal interval.

Note that the length between the upper and lower horizontal lines of each pattern is printed with 10 nozzles. Thus, when the 10 nozzles are converted by the number of pulses of the convey motor 58, the length corresponds to 36 pulses. This length is constant regardless of the presence or absence of the deviation in convey amount. Therefore, if a sheet convey amount error appears on the sheet, it appears as the deviation of the interval between the upper horizontal line of an intended pattern and the lower horizontal line of a previous pattern.

In the example of FIG. 4, while the respective intervals ΔDAn are set to the uniform value, the convey amount when the conveying roller 5 rotates once is 10 pulses less than that in the ideal state. Since the shortage of 10 pulses arises in the measurement performed 10 times, the convey amount when the conveying roller 5 rotates once is made equal to that in the ideal case by adding 1 pulse as the shortfall to the 40 pulses as the convey pulses each time the conveying roller 5 rotates once.

Further, the respective intervals ΔDAn are set to 4 pulses and are made equal to those in the ideal case, thereby the deviation in the convey amount is corrected. As described above, the deviation of the convey amount can be calculated in the range of the length of the one rotation of the conveying roller 5.

Further, the correction value (1 pulse), which is added to or subtracted from the reference convey pulses (40 pulses) each time the sheet is conveyed as described above, may not be stored in the non-volatile memory 53, but a sheet convey magnification ratio Mag determined by the following formula may be stored in the non-volatile memory 53 and may be multiplied by the reference convey pulse (40 pulses) each time the sheet is conveyed.

$$Mag=(Davg/F)*100\%$$

where, Davg shows the average value of the differences between the measured values of the respective intervals ΔDAn and the ideal (designed) interval ΔD, and F shows the convey amount of 40 pulses when the sheet is conveyed once. In this example, Davg is 1 because all the intervals ΔDAn are 3 pulses, from which the following formula is derived.

$$Mag=1/40*100\%=2.5\%.$$

When the printer prints an image, an appropriate sheet convey amount FC is calculated by multiplying the sheet convey magnification ratio Mag by the reference convey pulse.

$$FC=F+F*Mag$$

Next, a method of calculating a correction value for correcting irregularity in convey due to the decentering of the conveying roller 5 will be described with reference to FIG. 5.

Figure 5:
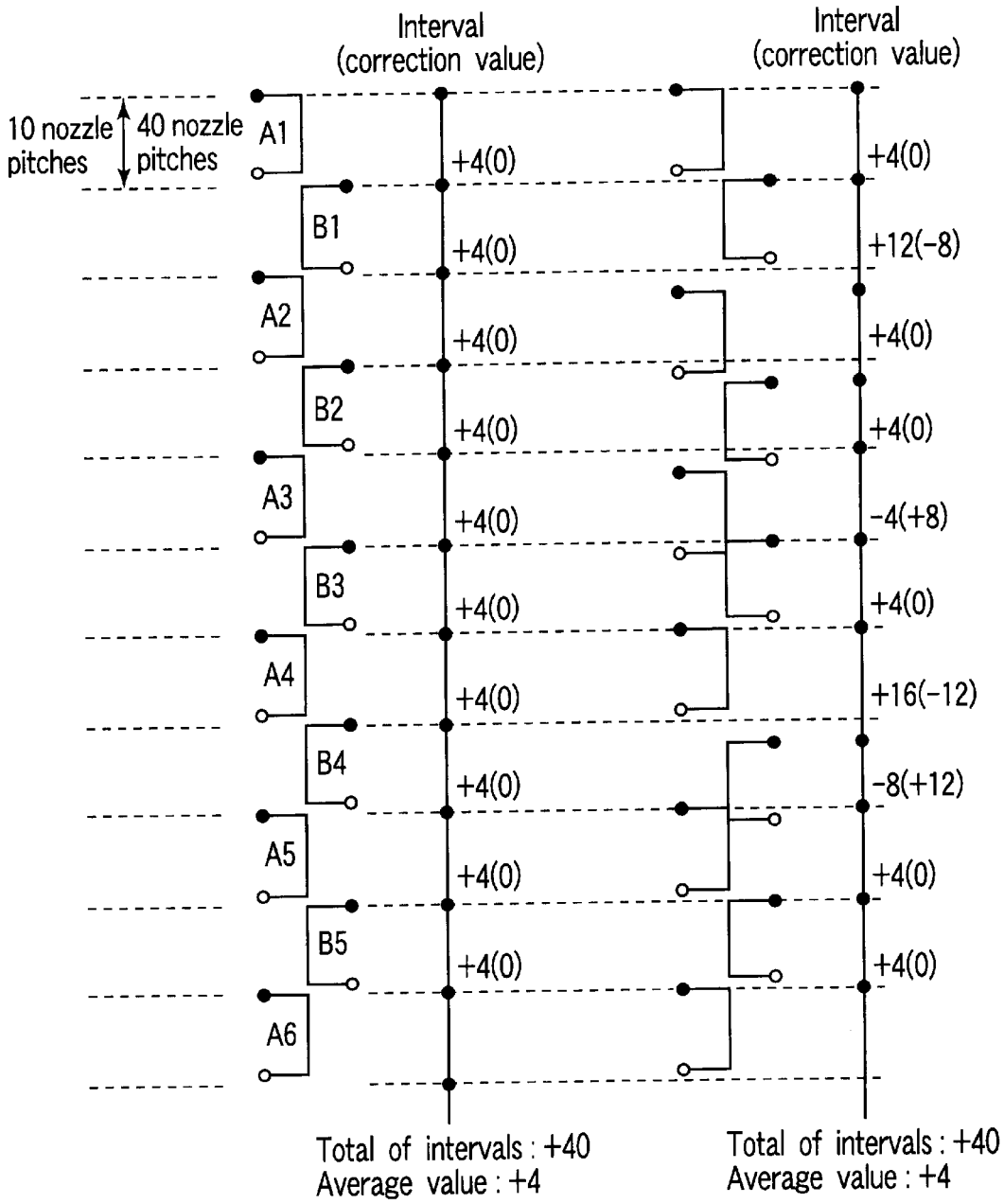
FIG. 5 is a view showing an example of the test pattern in the single path print employed by the inkjet printer according to the embodiment of the present invention.

FIG. 5 shows a test pattern, which is printed in an ideal state similarly to that shown in FIG. 4, on a left side, and shows a test pattern, in which only deviation in convey amount (irregularity in convey) is caused due to the decentering of the conveying roller 5, on a right side.

First, the total sum DA of the intervals ΔDA between the respective horizontal lines captured in the non-volatile memory 53 is calculated.

$$DA=\Delta DA1+\Delta DA2+, \ldots, +\Delta DA9+\Delta DA10$$

In the test patterns printed as shown in FIG. 5, the total sum DA is 40 pulses that is the same as that in the ideal state.

Next, the difference DB between the actually measured value DA of the total sum of the intervals and the reference value D is determined.

$$DB=D-DA$$

AS described above, it can be found that the actual convey amount of the sheet conveyed by the one rotation of the conveying roller 5 is the same as the convey amount of the sheet when the conveying roller 5 rotates once (the former is 0 pulse less than the latter) because D=DA=40 pulses and thus DB is 0 pulse.

That is, since the convey amount of the sheet by the one rotation of the conveying roller 5 is the same as that in the ideal case, it can be found that the convey surface length of the conveying roller 5 does not change.

As a result, the average value ΔDBmean of ΔDB is also 0.

$$\Delta Dmean=DB/n$$

where n shown the number of times of measurement, and n=10 in this example.

In short, no correction is necessary because the deviation in convey amount as to the convey amount of the sheet conveyed by the one rotation of the conveying roller 5 is the same as that in the ideal case, and thus ΔDBmean=0.

That is, the sheet convey magnification ratio is 1.0.

Next, an interval ΔDCn in consideration of the sheet convey magnification ratio is calculated by adding ΔDBmean to ΔDAn.

$$\Delta DCn=\Delta DAn+\Delta DBmean$$

Note that ΔDCn=ΔDAn because ΔDBmean is 0. Accordingly, ΔDCn does not equal the ideal interval of 4 pulses in all of n (n=1 to 10).

Since ΔDCn is not 4 pulses, a correction value ΔDDn is calculated next to correct the irregularity in convey. The correction value ΔDDn of the irregularity in convey is calculated by the following formula because it must be a value for setting each interval ΔDCn (=ΔDAn) to the ideal interval ΔD (4 pulses).

$$\Delta DDn=-\Delta DCn+\Delta D$$

A correction value ΔDEn, which takes the sheet convey magnification ratio and the decentering of the conveying roller into consideration, is finally calculated here by adding the correction value ΔDBmean, which corrects the deviation in convey amount caused by the one rotation of the conveying roller 5 each time the sheet is conveyed, to the correction value ΔDDn which corrects the deviation in convey amount due to the irregularity in convey each time the sheet is conveyed.

$$\Delta DEn=\Delta DBmean+\Delta DDn$$

However, ΔDEn=ΔDDn because ΔDBmean is 0.

The value ΔDEn is stored in the non-volatile memory 53 in the controller 34 and added to the convey pulses (40 pulses) supplied to the convey motor 58, thereby the actual convey amount comes near to an ideal convey amount. Note that the correction value of the sheet convey magnification ratio is set to 0 and stored in the non-volatile memory 53.

Next, a method of calculating a correction value for correcting the sheet convey amount error when deviation in convey amount due to the change of the convey surface length of the conveying roller 5 and irregularity in convey due to the decentering of the conveying roller 5 arise at the same time will be described with reference to FIG. 6. Note that the basic procedure of the method is the same as the method of calculating the correction value described above with reference to FIG. 5.

Figure 6:
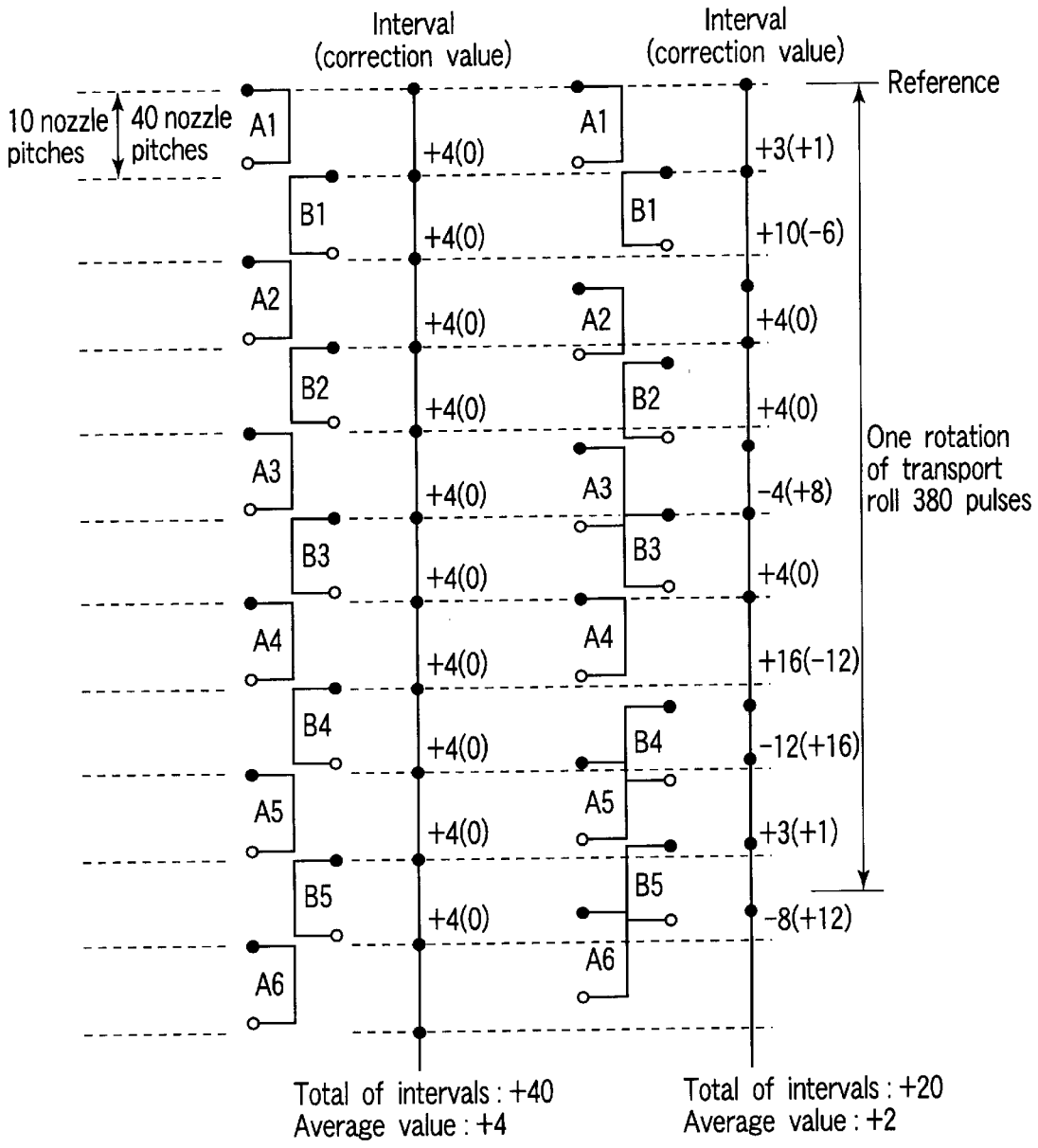
FIG. 6 is a view showing an example of the test pattern in the single path print employed by the inkjet printer according to the embodiment of the present invention.

FIG. 6 shows a test pattern, which is printed in an ideal state similarly to that shown in FIG. 4, on a left side, and shows a test pattern, in which the deviation in convey amount due to the change of the convey surface length of the conveying roller 5 and the irregularity in convey due to the decentering thereof arise at the same time, on a right side.

First, the total sum DA of the intervals ΔDA between the respective horizontal lines captured in the non-volatile memory 53 is calculated.

$$DA=\Delta DA1+\Delta DA2+, \ldots, +\Delta DA9+\Delta DA10$$

In the test pattern actually printed as shown in FIG. 6, the total sum DA amounts to 20 pulses. In contrast, in the ideal state, all the intervals ΔD between the respective horizontal lines are set to 4 pulses and measurement is performed 10 times, thus the total sum DA of the intervals amounts to 40 pulses. The value of ΔD=4 pulses in this ideal state is previously stored in the non-volatile memory 53, and the value obtained by multiplying this value by the number of times of measurement is used as a reference value D.

Next, the difference DB between the actually measured value DA and the reference value D is calculated.

$$DB=D-DA$$

As a result, it can be found that DB is 20 pulses and that the actual convey amount of the sheet conveyed by the one rotation of the conveying roller 5 is 20 pulses less the convey amount of the one rotation of the conveying roller 5.

That is, the length (which corresponds to 10 nozzles or 36 pulses) between the upper and lower horizontal lines of each pattern A and B of the test pattern is constant at all times regardless of deviation in sheet convey. Accordingly, the difference between the total sum DA of the intervals between the respective horizontal lines in the convey amount of the sheet conveyed by the one rotation of conveying roller 5 and the reference value D equals the sheet convey amount error of the one rotation of the conveying roller 5 as it is.

Next, the average value ΔDBmean of the differences DB of the total sum is determined.

$$\Delta Dmean=DB/n$$

where n means the number of times of measurement, and n=10 in this example.

As a result, ΔDBmean is +2 (pulses).

The average value ΔDBmean corresponds to a correction value for allocating the deviation in convey amount of the one rotation of the conveying roller 5 to the convey amount of the sheet each time it is conveyed.

Next, an interval ΔDCn after the primary correction is performed (after the sheet convey magnification ratio is corrected) is calculated by adding ΔDBmean to ΔDAn.

$$\Delta DCn=\Delta DAn+\Delta DBmean$$

When ΔDCn is calculated as to n=1 to 10, it is determined whether all the values of the thus calculate ΔDCn equal the interval ΔD (4) in the ideal state.

In this example, since none of the values ΔDC (10 pieces) equals the ΔD (4), the process goes to the next step (for example, ΔDC1 is +5, ΔDC2 is +10, . . . in the example of FIG. 7).

At the previous step, it is recognized that the disagreement of ΔDCn with ΔD means the occurrence of a sheet convey amount error due to irregularity in convey, and the difference ΔDDn between each interval ΔDCn and ΔD is further calculated. That is, in the interval ΔDCn, in which the deviation in convey amount caused by the one rotation of the conveying roller 5 is corrected by the addition of ΔDBmean to ΔDAn, the deviation in convey amount due to irregularity in convey, in which the deviation in convey amount caused by the one rotation of the conveying roller 5 is ignored, can be calculated each time the sheet is conveyed by calculating the difference between the ideal value ΔD and ΔDCn.

$$\Delta DDn=\Delta D-\Delta DCn$$

where ΔDDn shows a correction value for correcting irregularity in convey.

The correction value ΔDEn, which takes the sheet convey magnification ratio and the decentering of the conveying roller into consideration, is finally calculated here by adding the correction value ΔDBmean, which corrects the deviation in convey amount caused by the one rotation of the conveying roller 5 each time the sheet is conveyed, to the correction value ΔDDn which corrects the deviation in convey amount due to the irregularity in convey each time the print medium 35 is conveyed.

$$\Delta DEn=\Delta DBmean+\Delta DDn$$

The value ΔDEn is used as a final correction value and is stored in the non-volatile memory 53.

Note that when an image is actually recorded by single path recording, a sheet convey amount correction value ΔDE1 that is used when the print of a pattern A1 is switched to the print of a pattern B1 is set to +1 because ΔDBmean is 2 pulses and ΔDD1 is −1 pulse. That is, an initial sheet convey amount is set to 41 pulses by adding 1 pulse to the reference pulse of 40 pulses.

Further, the sheet convey magnification ratio Mag may be calculated by the following formula.

$$Mag=(Davg/F)*100\%$$

where Davg shows the average value of the differences between the measured values of the respective intervals ΔDAn and the ideal (designed) interval ΔD, and F shows a convey amount of 40 pulses when the sheet is conveyed once.

In this example, Mag is shown by the following formula because Davg is 2 pulses.

$$Mag=2/40*100\%=5\%$$

The CPU34 stores the Mag=5% in the non-volatile memory 53, and calculae a multiplication of multiplying the reference sheet convey amount of 40 pulses and the Mag, and resultingly the sheet convey amount error has been corrected by the sheet convey magnification ratio, the sheet convey amount error caused by irregularity in convey due to the decentering of the conveying roller 5 must be corrected.

Next, a method of calculating the sheet convey magnification ratio and a method of calculating the correction value for correcting the irregularity in convey at the time multi-path print will be described with reference to FIG. 8.

First, a method of printing a test pattern will be described.

A print head used here has 248 nozzles. A sheet is conveyed in the amount of 124 dots at a time. In the following description, it is assumed that 1 nozzle pitch corresponds to 1 dot pitch. The test pattern is formed by repeating a plurality of times of a print operation for printing 31 horizontal lines at intervals of 8 dots in each scan. This print operation is repeated until the amount of the sheet having been conveyed reaches the convey amount of the sheet conveyed by the one rotation of the conveying roller 5.

Figure 8:
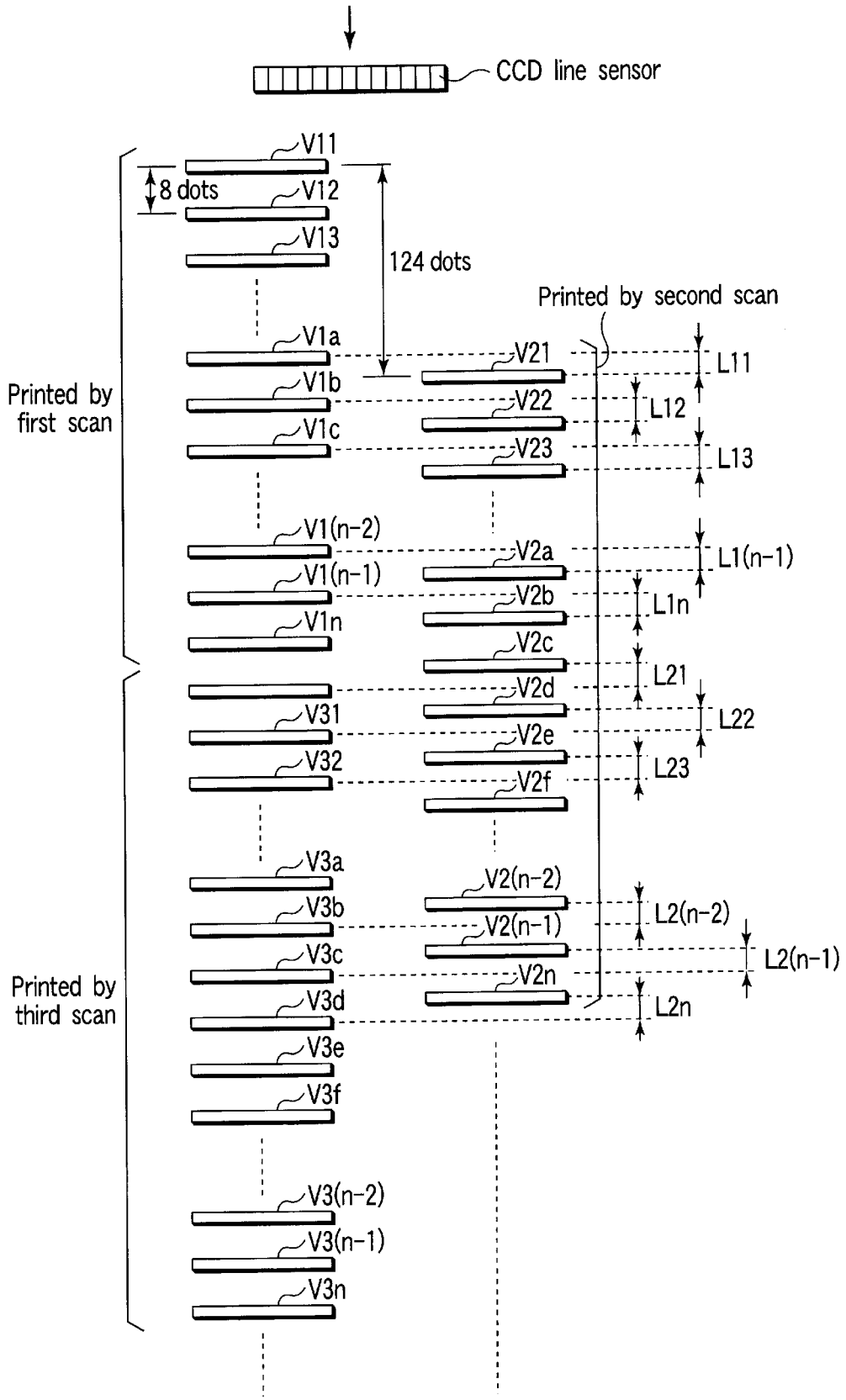
FIG. 8 is a view showing an example of the test pattern in a multi-path print employed by the inkjet printer according to the embodiment of the present invention.

FIG. 8 shows the test pattern printed to a third scan.

The positions of the horizontal lines printed in a first scan equal those of the horizontal lines printed in a third scan in a main scan direction. Further, the horizontal lines printed in a second scan are located adjacent to the horizontal lines printed in the first or third scan in the main scan direction.

An amount of deviation of conveyed sheet is calculated by measuring the intervals between the horizontal lines printed in the first scan and those printed in the second scan and further measuring the intervals between the horizontal lines printed in the second scan and those printed in the third scan.

The following description will be made assuming that one convey pulse supplied to the convey motor 58 is equal to 1 dot pitch (=nozzle pitch). Note that while the print head 30 having 360 dpi is used, any recording head other than it may be employed.

Next, a method of reading the test pattern will be described.

The CCD 37 is divided into a plurality of regions according to the respective reading functions thereof along a direction in which the image pickup elements thereof are disposed. That is, the CCD 37 reads the horizontal lines printed by the first and third scans by the left region thereof and reads the horizontal lines printed by the second scan by the right region thereof. The CCD 37 is mounted on the carriage 17 and reads the test pattern by conveying the print medium 35.

Next, a procedure for actually reading the test pattern will be described.

First, the CCD 37 is moved to an initial position. The CCD 37 is moved to the initial position by moving the carriage 17 as to the main scan direction and by moving the sheet by the convey motor 58 as to the sub-scan direction.

Subsequently, the horizontal lines of the test pattern begin to be read. The CCD 37 relatively moves downward in FIG. 8 from the state shown in the figure. Actually, the horizontal lines are read by fixing the CCD 37 and by conveying the sheet upward in the figure.

Then, a horizontal line V11 printed by the first scan is detected by the image pickup elements of the left region of the CCD 37. The number of pulses of sheet convey data corresponding to the position data of the thus detected horizontal line is stored in the non-volatile memory 53.

When the sheet is further conveyed in this manner and a horizontal line V12 is detected following to the horizontal line V11 by the image pickup elements of the left region of the CCD 37, the position data of the horizontal line V12 is stored in the non-volatile memory 53 in place of the position data of the horizontal line V11 detected previously because horizontal lines printed by the first scan are detected continuously.

When a horizontal line V1*a* is detected by the CCD 37, the position data thereof is stored in the non-volatile memory 53 in place of the position data of the horizontal line detected previously.

When the print medium 35 is further conveyed in this manner, a horizontal line V21 is detected by the image pickup elements of the right region of the CCD 37. Then, the position data of the horizontal line V21 printed by the second scan is stored in the non-volatile memory 53. Thereafter, a horizontal line printed by the first scan and a horizontal line printed by the second scan are alternately detected by the image pickup elements of the left and right regions of the CCD 37. Each time the horizontal line is detected, the number of pulses, which correspond to the position data when the horizontal line is detected and which are supplied to the convey motor 58, is stored in the non-volatile memory 53.

Further, after the horizontal lines printed by the first scan have been detected, a horizontal line V31 printed by the third scan begins to be detected. When the horizontal line V31 is detected, the position data thereof is stored in the non-volatile memory 53, in the same way.

The above processing is carried out until a state arises in which horizontal lines printed by the second scan are not continuously detected by the image pickup elements of the right region of the CCD 37.

Next, a method of calculating a correction value will be described.

First, the position data of the horizontal line V1*a*, which is printed by the first scan, is compared with the position data of the horizontal line V21, which is printed by the second scan and is detected just after the horizontal line V1*a* is detected, and the position interval L11 therebetween is calculated and stored in the non-volatile memory 53. Next, the position data of a horizontal line V1*b*, which is printed by the first scan, is compared with the position data of a horizontal line V22, which is printed by the second scan and detected just after the horizontal line V1*b* is detected, and the position interval L12 therebetween is calculated and stored in the non-volatile memory 53.

Thereafter, position intervals are continuously calculated until a position interval L1*n* is calculated.

Next, the position data of a horizontal line V2*c*, which is printed by the second scan, is compared with the position data of the horizontal line V31, which is printed by the third scan and detected just after the horizontal line V2*c* is detected, and the position interval L21 therebetween is calculated and stored in the non-volatile memory 53.

Subsequently, the position data of a horizontal line V2*d*, which is printed by the second scan, is compared with the position data of a horizontal line V32, which is printed by the third scan and is detected just after the horizontal line V2*d* is detected, and the position interval L22 therebetween is calculated and stored in the non-volatile memory 53.

Thereafter, the position intervals between the horizontal lines printed by the second scan and those printed by the third scan are calculated until the position interval between a lowermost horizontal line V2*n* printed by the second scan and a horizontal line V3*d* printed by the third scan is detected, and these position intervals are stored in the non-volatile memory 53.

Further, while not shown in FIG. 8, the position intervals between the horizontal lines printed by fourth and subsequent scans are also calculated.

Next, the data L11 to L2*n* of each of the thus calculated position interval is compared with the number of pulses of 4 dots (half 8 dots) that is an ideal (designed) value, and the difference therebetween is calculated as to the data of the respective position intervals. When the differences between the data of all the position intervals and the ideal value are calculated, the total sum of the differences is calculated, and an average value Davg is calculated from the total sum of the differences. If this average value Davg is not 0, an actual convey amount of the sheet by the one rotation of the conveying roller 5 is deviated from the ideal convey amount thereof. That is, the sheet convey magnification ratio Mag is not 1.0.

The sheet convey magnification ratio Mag is calculated by the following formula.

$$Mag=(Davg/F)*100$$

In this formula, F shows the convey amount of the sheet when it is conveyed once to print a horizontal line (124*25.4/360 mm). For example, it is assumed that all the intervals between the right horizontal lines and all the intervals between the left horizontal lines are calculated and that the average value Davg thereof is −0.104. In this case, the sheet convey magnification ratio Mag=−1.18 is calculated from the above formula.

This sheet convey magnification ratio Mag is stored in the non-volatile memory 53 and is multiplied by a reference sheet convey amount of 124 dots when an image is actually recorded, thereby the sheet is appropriately conveyed.

Further, while a method of calculating a correction value for correcting a sheet convey amount error for correcting irregularity in convey due to the decentering of the conveying roller 5 is basically similar to the method of the single path print described above, the method will be described in the assumption that the sheet convey magnification ratio has been calculated.

In the following description, ΔD means the average value (4 dots) of the intervals of respective horizontal lines in an ideal state, and D means the total sum of ΔD. DA means the total sum of ΔDA1, DA2, . . . , and DBmean means the average value (=0) of the differences between D and DA.

Further, ΔDA1 means the average value of the intervals between the respective horizontal lines printed by the first scan and those printed by the second scan, and ΔDA2 means the average value of the intervals between the respective horizontal lines printed by the second scan and those printed by the third scan. Then, ΔDCn means the position intervals (ΔDAn+ΔD) between the respective horizontal lines after the sheet convey magnification ratio is corrected.

First, it is determined whether or not all the intervals ΔDCn between the respective horizontal lines having been corrected by the sheet convey magnification ratio equal ΔD (it is assumed here that none of them equals ΔD).

Since none of the intervals ΔDCn equals ΔD, a correction value ΔDDn is calculated next to correct the irregularity in convey. That is, the amount of deviation of the intervals ΔDCn from an ideal interval value is calculated by the following formula.

$$\Delta DDn=\Delta D-\Delta DCn$$

Then, a final correction value ΔDEn is calculated by adding the correction value ΔDBmean, which is used each time the sheet is conveyed to correct the sheet convey magnification ratio, to the correction value ΔDDn, which is used each time the sheet is conveyed to correct the irregularity in convey.

$$\Delta DEn=\Delta DDn+\Delta DBmean$$

However, ΔDBmean is 0 because the sheet convey magnification ratio is 1.0.

The value ΔDEn is the final correction value and is stored in the non-volatile memory 53.

In the actual recording of the image, a sheet convey amount at the time the print performed by the first scan is switched to the print performed by the second scan is 124+ΔDE1 dots, and a sheet convey amount at the time the print performed by the second scan is switched to the print performed by the third scan is 124+ΔDE2 dots.

The embodiment of the present invention has been described above. In the multi-path print, however, a plurality of horizontal lines are printed by one scan, and the intervals between the plurality of horizontal lines printed by previous scan and present scan are calculated. Accordingly, even if some of a plurality of nozzles for printing the plurality of horizontal lines have abnormal ink ejection characteristics, the abnormal characteristics do not almost adversely affect the calculation of the sheet convey magnification ratio because they are averaged.

When, for example, one of particular (only two) nozzles has abnormal ink ejection characteristics in the single path print, a measured interval is greatly deviated from an interval to be actually measured, and a sheet convey magnification ratio calculated based on the deviated interval greatly changes. In the multi-path print, however, such a disadvantage does not arise.

That is, the sheet convey magnification ratio has somewhat different meaning between the single path print and the multi-path print. That is, in the single path print, the sheet convey magnification ratio is used to cause the interval between the lower horizontal line of a test pattern printed by previous scan and the upper horizontal line of a test pattern printed in subsequent scan to equal a predetermined interval. In contrast, in the multi-path scan, it is used to print a plurality of horizontal lines printed by previous scan and a plurality of horizontal lines printed by subsequent scan in a well-balanced state.

Therefore, it must be kept in mind that even if the same printer and the same sheet are used, in some cases, the value of a sheet convey magnification ratio calculated by printing a test pattern by the single path print may be different from that calculated by printing a test pattern by the multi-path print.

Accordingly, it is preferable to calculate the sheet convey magnification ratio in the respective recording modes provided with a printer. For example, in a printer in which one-path, two-path, four-path, and eight path recording modes, for example, are set as printing modes, a sheet convey magnification ratio is calculated in each of the recording modes. The CPU34 controls to store the radio in the non-volatile memory 53 before printing is actually performed. Then, when it is intended to actually perform the printing by the 4-path printing, the sheet convey magnification ratio according to the 4-path printing stored in the memory is read prior to the start of the printing, and a sheet convey amount is calculated in consideration of the value and set.

When the test pattern is printed in the above embodiment, the sheet convey amount is caused to equal the sheet convey by the one rotation of the conveying roller 5. It is more preferable, however, to multiple the sheet convey amount of the one rotation of the conveying roller 5 and to obtain the average value of the multiple sheet convey amount in order to calculate of a more accurate sheet convey magnification ratio.

Further, when a test pattern is recorded in the above embodiment, the sheet convey amount of the sheet when it is conveyed once is less than that in the single path print. Thus, irregularity in sheet convey, which is caused in the sheet convey amount corresponding to the one rotation of the conveying roller 5, is measured more often than in the single path printing. That is, when it is intended to detect irregularity in sheet convey and to create the profile thereof, the multi-path printing can create it more finely in more detail than the single path printing.

When the correction value for correcting the irregularity in sheet convey is calculated in the single path printing, not only the more fine and more accurate correction value for correcting the irregularity in sheet convey can be obtained but also the man-hour necessary to print and read a test pattern used in the single path printing can be reduced by calculating the correction value based on the profile of the irregularity in sheet convey created using the test pattern printed by the multi-path printing.

While the embodiment of the present invention has been described above, the present invention is by no means limited thereto and it goes without saying that various improvements and modifications can be made without departing from the gist of the present invention.

According to the present invention, there can be provide an image recording apparatus such as an inkjet printer capable of effectively determining a sheet convey amount error and calculating an appropriate correction value by without recording and reading test data over the entire region of a sheet.

Further, the present invention can provide an image recording apparatus such as an inkjet printer capable of using sheets having a different thickness and capable of determining an appropriate sheet convey amount error for each sheet having a different thickness and a different coefficient of friction and calculating an appropriate correction value easily and promptly.

In more detail, the present invention can provide an image recording apparatus such as an inkjet printer that can save the useless consumption of time, an amount of ink, and sheets when a sheet convey amount error is measured by using a length corresponding to the sheet convey amount of the one rotation of a conveying roller as a measurement range when the sheet convey amount error is measured.

Further, the present invention can provide an image recording apparatus such as an inkjet printer that permits a sheet convey magnification ratio for correcting deviation in convey amount to be calculated independently and permits a sheet convey magnification ratio to be calculated according to each of respective recording modes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording apparatus comprising:

a conveying roller which conveys a print medium;

a print head which is capable of scanning the print medium in a direction perpendicular to the direction where the print medium is conveyed by the conveying roller and which records a test pattern on the print medium;

a scanner which reads the test pattern recorded on the print medium; and an arithmetic operation circuit which calculats the convey amount error of the conveying roller based on the result detected by the scanner, wherein the conveying roller conveys each of a plurality of the sub-regions that are obtained by dividing the region of the print medium, which corresponds to the convey amount of the print medium conveyed by the one rotation of the conveying roller, at a time;

the print head records a test pattern each time the print medium is conveyed by the conveying roller and records a plurality of test patterns in the region of the print medium corresponding to the convey amount of the one rotation of the conveying roller; and the arithmetic operation circuit:

(a) calculates an interval between test patterns that are adjacent to each other along the direction where the print medium is conveyed;

(b) calculates the amount of deviation between the calculated interval and an ideal interval as to all the test patterns recorded on the print medium; and (c) calculates the average value of the amounts of deviation.

2. An image recording apparatus according to claim 1, wherein each of the plurality of test patterns has a plurality of horizontal lines disposed at predetermined intervals along the direction where the print medium is conveyed.

3. An image recording apparatus according to claim 2, wherein the test patterns adjacent to each other along the direction where the print medium is conveyed are recorded by being dislocated along the scan direction of the print head.

4. An image recording apparatus according to claim 2, wherein the test patterns recorded by the scan performed at odd times are disclosed from the test patterns recorded by the scan performed at even times along the scan direction of the print head.

5. An image recording apparatus according to claim 1, wherein a controller calculates a sheet convey magnification ratio by dividing the average value of the amounts of deviation by the convey amount of the sheet conveyed by the one rotation of the conveying roller.

6. An image recording apparatus according to claim 5, further comprising a memory which stores the sheet convey magnification ratio calculated by the arithmetic operation circuit.

7. An image recording apparatus according to claim 6, wherein the test patterns are different according to a recording mode.

8. An image recording apparatus according to claim 7, wherein the arithmetic operation circuit calculates a plurality of sheet convey magnification ratios according to each recording mode, and the memory stores the plurality of sheet convey magnification ratios according to each recording mode, respectively.

9. An image recording apparatus according to claim 7, wherein a sheet convey magnification ratio according to the recording mode when an image is actually recorded is selected from the plurality of sheet convey magnification ratios stored in the memory.

10. An image recording apparatus according to claim 4, wherein the scanner has a first scanner region for reading the test patterns recorded by the scan at the odd times and a second scanner region, which is different from the first scanner region, for reading the test patterns recorded by the scan at the even times.

11. An image recording apparatus comprising:

a conveying roller which conveys a print medium;

a convey motor which applies rotational drive to the conveying roller;

a print head which records test patterns on the print medium;

a carriage which causes the print head mounted thereon to perform scan in a direction perpendicular to the direction where the print medium is conveyed by the conveying roller;

a sensor which optically reads the test patterns recorded on the print medium; and an arithmetic operation circuit which calculates the convey amount error of the conveying roller based on the result detected by the scanner, wherein the print head records a test pattern each time the print medium is conveyed by the conveying roller and records a plurality of test patterns in the region of the print medium corresponding to the convey amount of the one rotation of the conveying roller; and the arithmetic operation circuit:

(a) calculates an interval ΔDAn of test patterns that are adjacent to each other along the direction where the print medium is conveyed as to intervals of all the test patterns and calculates a total sum DA of the intervals;

(b) calculates the amount of deviation DB between the thus calculated total sum DA of the intervals and a total sum D of ideal intervals;

(c) calculates a first correction amount ΔDBmean by calculating the average value of the amount of deviation DB between the total sums DA and D;

(d) calculates a primary correction interval ΔDCn by adding the first correction value ΔDBmean to the intervals ΔDAn of the respective test patterns;

(e) calculates a second correction amount ΔDDn by calculating the difference between the first correction amount ΔD and the primary correction interval ΔDCn; and (f) adds the first correction amount ΔDBmean to the second correction amount ΔDDn.

12. An image recording apparatus according to claim 11, wherein each of the plurality of test patterns has a plurality of horizontal lines disposed at predetermined intervals along the direction where the print medium is conveyed.

13. An image recording apparatus according to claim 12, wherein the test patterns recorded by the scan performed at odd times are disclosed from the test patterns recorded by the scan performed at even times along the scan direction of the print head.

14. An image recording apparatus according to claim 11, wherein the arithmetic operation circuit calculates a sheet convey magnification ratio Mag by dividing the first correction amount ΔDBmean by the convey amount F of the print medium when it is conveyed once.

15. A image recording apparatus according to claim 11, further comprising a memory which stores a sheet convey magnification ratio Mag calculated by the arithmetic operation circuit.

16. An image recording apparatus according to claim 15, wherein the test patterns are different according to a recording mode.

17. An image recording apparatus according to claim 16, wherein the arithmetic operation circuit calculates a plurality of sheet convey magnification ratios Mag according to each recording mode, and the memory stores the plurality of sheet convey magnification ratios Mag according to each recording mode, respectively.

18. An image recording apparatus according to claim 17, wherein a sheet convey magnification ratio Mag according to the recording mode when an image is actually recorded is selected from the plurality of sheet convey magnification ratios Mag stored in the memory.

19. An image recording apparatus according to claim 13, wherein the scanner has a first scanner region for reading the test patterns recorded by the scan at the odd times and a second scanner region, which is different from the first scanner region, for reading the test patterns recorded by the scan at the even times.

* * * * *